US011655987B2

(12) United States Patent
Yu et al.

(10) Patent No.: US 11,655,987 B2
(45) Date of Patent: May 23, 2023

(54) WINDOW AIR CONDITIONER WITH MOUNTING BASE

(71) Applicants: GD MIDEA AIR-CONDITIONING EQUIPMENT CO., LTD., Foshan (CN); MIDEA GROUP CO., LTD., Foshan (CN)

(72) Inventors: Hui Yu, Foshan (CN); Zhigang Xing, Foshan (CN); Yu Liu, Foshan (CN); Kangwen Zhang, Foshan (CN); Zhisheng Lei, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 16/901,590

(22) Filed: Jun. 15, 2020

(65) Prior Publication Data

US 2021/0164667 A1 Jun. 3, 2021

Related U.S. Application Data

(63) Continuation of application No. PCT/CN2020/077618, filed on Mar. 3, 2020.

(30) Foreign Application Priority Data

Nov. 29, 2019 (CN) ..... 201911218447.5
Nov. 29, 2019 (CN) ..... 201922132503.5

(51) Int. Cl.
*F24F 1/031* (2019.01)
*F24F 1/027* (2019.01)
(Continued)

(52) U.S. Cl.
CPC ..... *F24F 1/031* (2019.02); *F24F 1/027* (2013.01); *F24F 13/32* (2013.01); *E06B 7/02* (2013.01); *E06B 7/03* (2013.01)

(58) Field of Classification Search
CPC ..... F24F 1/027; F24F 1/031; F24F 13/224; F24F 2221/20; F24F 13/32;
(Continued)

(56) References Cited

U.S. PATENT DOCUMENTS 2,604,763 A * 7/1952 Lipman ..... F24F 1/027 62/262
2,781,717 A * 2/1957 Hord ..... F24F 1/04 454/203
(Continued)

FOREIGN PATENT DOCUMENTS

CN 204787107 U 11/2015
CN 105485786 A 4/2016
(Continued)

OTHER PUBLICATIONS

World Intellectual Property Organization (WIPO) International Search Report and Written Opinion for PCT/CN2020/077618 dated Aug. 26, 2020 18 Pages.
(Continued)

*Primary Examiner* — Edelmira Bosques
*Assistant Examiner* — Frances F. Hamilton
(74) *Attorney, Agent, or Firm* — Anova Law Group PLLC

(57) ABSTRACT

A window air conditioner includes a housing including a separation groove dividing the housing into two parts, a mounting base movably mounted in the separation groove, and a sealing member connected with the mounting base. The sealing member is fitted with the mounting base by deformation, and the sealing member is configured to be
(Continued)

driven by the mounting base to switch between a storage state and a working state. In the storage state, the sealing member is received in the separation groove. In the working state, the sealing member is at least partially outside the separation groove.

17 Claims, 12 Drawing Sheets

(51) Int. Cl.
*F24F 13/32* (2006.01)
*E06B 7/02* (2006.01)
*E06B 7/03* (2006.01)

(58) Field of Classification Search
CPC ..... Y10T 24/44694; Y10T 24/24711; Y10T 24/44769; Y10S 248/916
USPC ..... 248/200.1
See application file for complete search history.

(56) References Cited

U.S. PATENT DOCUMENTS 3,392,546 A * 7/1968 Reed ..... F24F 1/029 62/262
4,118,838 A * 10/1978 Schiefer ..... F16L 3/13 248/68.1
4,766,738 A * 8/1988 Ebata ..... F24F 1/027 62/272
D330,413 S * 10/1992 Kennedy ..... D23/353
5,167,131 A * 12/1992 Karkhanis ..... F24F 1/027 62/262
5,253,485 A * 10/1993 Kennedy ..... F24F 1/027 454/201
5,295,903 A * 3/1994 Bolton ..... F24F 1/027 454/201
5,582,025 A * 12/1996 Dubin ..... F24F 13/32 62/262
D380,533 S * 7/1997 Molnar ..... D23/351
6,389,834 B1 * 5/2002 LeClear ..... F24F 13/222 62/262
6,568,201 B1 * 5/2003 Cur ..... F24F 1/027 62/262
7,121,105 B1 * 10/2006 Rais ..... F24F 1/027 62/262
10,520,206 B2 * 12/2019 Xu ..... F24F 13/12
10,689,901 B2 * 6/2020 O'Leary ..... H02G 3/083
2003/0042010 A1 * 3/2003 Kobayashi ..... F24F 13/20 165/122
2003/0097854 A1 * 5/2003 Cur ..... F24F 1/027 62/262
2011/0220596 A1 * 9/2011 Cusson ..... F24S 25/13 24/522
2017/0191679 A1 * 7/2017 Xu ..... F24F 13/32
2020/0248911 A1 * 8/2020 Lei ..... F24F 13/32
2021/0199332 A1 * 7/2021 Xing ..... F24F 11/52
2021/0207819 A1 * 7/2021 Zhang ..... F24F 13/32
2021/0355750 A1 * 11/2021 Liang ..... E06B 7/18
2022/0003242 A1 * 1/2022 Huang ..... F04D 29/263

FOREIGN PATENT DOCUMENTS

CN 206648183 U 11/2017
CN 108870565 A 11/2018
CN 108870565 A * 11/2018 ..... F24F 1/027
CN 109184456 A 1/2019
CN 109724168 A * 5/2019
CN 109724170 A * 5/2019 ..... F24F 1/027
CN 109724171 A * 5/2019
CN 109724171 A 5/2019
CN 109724172 A * 5/2019
CN 109974128 A * 7/2019
CN 209706234 U * 11/2019
CN 110736148 A 1/2020
CN 209944569 U * 1/2020
CN 110822562 A 2/2020
CN 111059638 A 4/2020
CN 210463300 U * 5/2020 ..... E06B 7/18
CN 211119701 U 7/2020
CN 215409350 U * 1/2022
JP 58104435 A 6/1983
JP 2016191534 A 11/2016
KR 20070021010 A * 2/2007
KR 20110002841 U * 9/2009 ..... E06B 7/03
WO WO-2018133156 A1 * 7/2018 ..... F24F 1/02
WO WO-2020037956 A1 * 2/2020 ..... F24F 1/027
WO WO-2020092081 A1 * 5/2020

OTHER PUBLICATIONS

Canadian Intellectual Property Office The Office Action for CA Application No. 3086289 dated Feb. 23, 2022 4 Pages.
Canadian Intellectual Property Office The Office Action for CA Application No. 3086289 dated Aug. 25, 2021 5 Pages.

* cited by examiner

WINDOW AIR CONDITIONER WITH MOUNTING BASE

CROSS-REFERENCE TO RELATED APPLICATIONS

This application is a continuation of International Application No. PCT/CN2020/077618, filed on Mar. 3, 2020, which claims priority to Chinese Application Nos. 201911218447.5 and 201922132503.5, filed on Nov. 29, 2019, the entire contents of all of which are incorporated herein by reference.

TECHNICAL FIELD

The present disclosure relates to the technical field of air conditioners, in particular to a window air conditioner.

BACKGROUND

In the related art, the window air conditioner is mounted at the mounting opening of the wall. The window air conditioners usually use sealing member to seal the gap between the inner wall of the mounting opening and the shielding member (such as a window shutter, a curtain, a sash, etc.) on the mounting opening to reduce leakage of indoor cooling or heat to the outdoor through the gap. However, conventional sealing member is generally mounted at the window air conditioner through the coordination of multiple components. Moreover, the sealing member needs to be fixedly connected to these components by using a screw structure or a clamping structure, such that the assembly of the sealing member is more complicated and cumbersome, and the assembly efficiency is lower.

SUMMARY

The main objective of the present disclosure is to provide a window air conditioner, which aims to simplify the assembly method of the sealing member, thereby improving the assembly efficiency of the whole machine.

In order to achieve the above objective, the present disclosure provides a window air conditioner, including: a housing including a separation groove, the separation groove being configured for a shielding member located at a mounting opening of a wall to extend into; a mounting base movably mounted in the separation groove; and a sealing member connected with the mounting base through insertion, the sealing member being in interference fit with the mounting base by deformation, and the sealing member being driven by the mounting base to switch between a storage state and a working state; in the storage state, the sealing member is received in the separation groove; in the working state, the sealing member is configured to extend laterally from the separation groove, and abut on the shielding member and/or an inner wall of the mounting opening.

In some embodiments, the mounting base includes a bottom mounting plate and two side mounting plates on opposite sides of the bottom mounting plate, the bottom mounting plate being rotatably mounted in the separation groove, a mounting slot for receiving the sealing member being formed among the bottom mounting plate and the two side mounting plates.

In some embodiments, a guiding protrusion bar protrudes on an inner wall surface of the side mounting plate, the guiding protrusion bar being elongated and configured to extend along an insertion direction of the mounting slot.

In some embodiments, the guiding protrusion bar includes a root connected to the side mounting plate and a top away from the side mounting plate, a thickness of the guiding protrusion bar gradually decreasing from the root to the top.

In some embodiments, the guiding protrusion bar is inclined towards a bottom wall of the mounting slot from the root to the top.

In some embodiments, a guiding slope is formed at an end of the guiding protrusion bar, the guide slope being inclined along the insertion direction of the mounting slot.

In some embodiments, an outer wall surface of the side mounting plate is further provided with a groove, the groove being elongated and configured to extend along the insertion direction of the mounting slot.

In some embodiments, the bottom mounting plate of the mounting base is provided with two rotation arms protruding downwards, a fixation base is mounted in the separation groove, and the fixation base is rotatably connected with the rotation arm.

In some embodiments, the fixation base includes a bottom fixation plate and two side fixation plates on opposite sides of the bottom fixation plate, a receiving groove being formed between the two side fixation plates, the rotation arm being configured to extend into the receiving groove, one of the side fixation plate and the rotation arm being configured to form a shaft hole, the other of the side fixation plate and the rotation arm being configured to form a rotation shaft fit in the shaft hole.

In some embodiments, a rotation angle of the rotation arm of the mounting base is adjustable.

In some embodiments, one of the side fixation plate and the rotation arm is formed with a positioning protrusion on a periphery of the rotation shaft, and the other of the side fixation plate and the rotation arm is formed with positioning grooves on a periphery of the shaft hole, the positioning protrusion is cooperated with one of the positioning grooves to position the mounting base when the mounting base rotates to a preset angle.

In some embodiments, a rotation portion is formed at a tail end of the rotation arm, the rotation portion having two opposite side walls, the rotation shaft protruding on one of the side walls; a boss towards the receiving groove protrudes on the side fixation plate, the boss being formed with the shaft hole for receiving the rotation shaft.

In some embodiments, a connection plate is formed between two side walls of the rotation portion, and a hollow groove is formed between two adjacent connection plates.

In some embodiments, the fixation base further includes two rib plates on a surface of the side fixation plate away from the boss, and a cover plate on a side edge of the side fixation plate away from the bottom fixation plate, the cover plate being connected to the two rib plates and enclosed with the two rib plates to form an avoiding groove corresponding to the shaft hole.

In some embodiments, a lower end of the rib plate is chamfered to form a guiding portion at a chamfered position of the rib plate.

In some embodiments, a sink groove for mounting the fixation base is provided at a bottom of the separation groove, the sink groove being provided with a drain hole, the drain hole being configured to drain water outdoors or in a water receiving tray.

In some embodiments, the sealing member is made of a flexible material, to enable the sealing member to deform flexibly; or the sealing member is made of an elastic material, to enable the sealing member to deform elastically.

In some embodiments, a length of the sealing member is varied through cutting the sealing member.

In some embodiments, the window air conditioner further includes a compressor, an outdoor heat exchanger, an outdoor fan, an indoor heat exchanger, and an indoor fan; the housing is divided into an indoor housing and an outdoor housing by the separation groove, the compressor, the outdoor heat exchanger and the outdoor fan being mounted in the outdoor housing, and the indoor heat exchanger and the indoor fan being mounted in the indoor housing.

In the technical solutions of the present disclosure, the sealing member is connected with the mounting base through insertion, the sealing member is in interference fit with the mounting base by elastic or flexible deformation, such that the assembly of the sealing member and the mounting base does not require components such as a screw structure or a clamping structure, the assembly process is relatively simple, and the operation difficulty is low, which helps to improve assembly efficiency.

Besides, the sealing member is driven by the mounting base to switch between a storage state and a working state. In the storage state, the sealing member is received in the separation groove to fully utilize the separation groove to store the sealing member, which reduces the volume of the window air conditioner and is convenient for storage or package and transportation. In the working state, the sealing member is configured to extend laterally from the separation groove, and is configured for abutting on the shielding member and/or an inner wall of the window to seal the gap between the shielding member and the inner wall of the mounting opening, and to reduce the leakage of cold or heat to the outside, and to prevent water in the outdoor environment from falling into the room from the gap, which greatly enhances the sealing effect.

BRIEF DESCRIPTION OF THE DRAWINGS

In order to more clearly illustrate the embodiments of the present disclosure, the drawings used in the embodiments will be briefly described below. Obviously, the drawings in the following description are only some embodiments of the present disclosure. It will be apparent to those skilled in the art that other figures can be obtained from the structures illustrated in the drawings without inventive effort.

DESCRIPTION OF REFERENCE NUMERALS

TABLE 1

Figure 1:
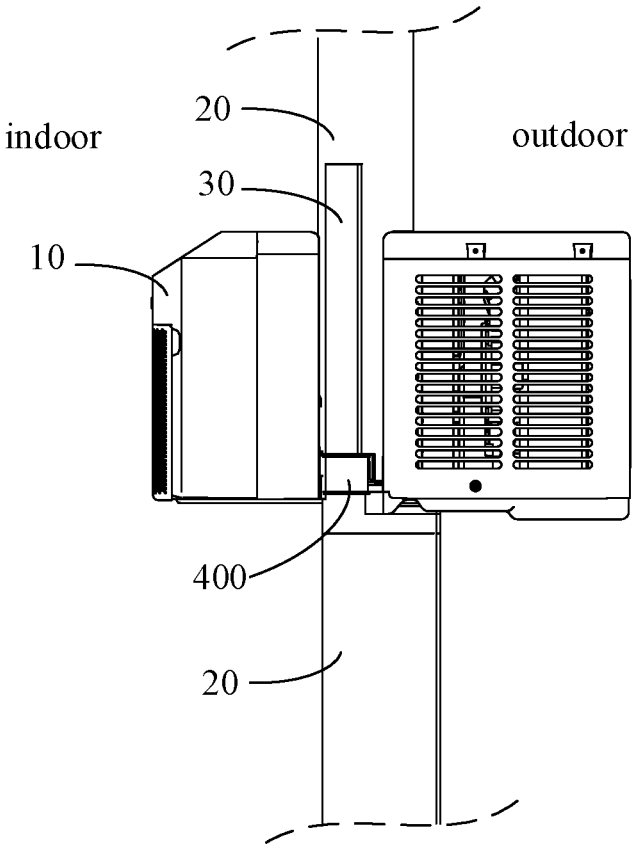
FIG. 1 is a schematic diagram showing a window air conditioner mounted at a wall according to the present disclosure.

| Reference Numeral | Name |
|---|---|
| 10 | window air conditioner |
| 20 | wall |
| 30 | shielding member |
| 100 | housing |
| 110 | indoor housing |
| 120 | outdoor housing |
| 200 | separation groove |
| 210 | sink groove |
| 300 | mounting base |
| 310 | bottom mounting plate |
| 320 | side mounting plate |
| 321 | guiding protrusion bar |
| 3211 | root |
| 3212 | top |
| 322 | guiding slope |
| 323 | groove |
| 324 | recess |
| 330 | mounting slot |
| 340 | rotation arm |
| 341 | rotation shaft |
| 342 | positioning protrusion |
| 343 | rotation portion |
| 301 | side wall |
| 302 | connection plate |
| 303 | hollow groove |
| 400 | sealing member |
| 500 | fixation base |
| 510 | bottom fixation plate |
| 520 | side fixation plate |
| 521 | shaft hole |
| 522 | positioning groove |
| 523 | boss |
| 530 | rib plate |
| 531 | guiding portion |
| 540 | cover plate |
| 501 | receiving groove |
| 502 | avoiding groove |

The realization of the objective, functional characteristics, advantages of the present disclosure are further described with reference to the accompanying drawings.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that, if there is directional indication (such as up, down, left, right, front, rear . . . ) in the embodiments of the present disclosure, the directional indication is only used to explain the relative positional relationship and movement between the components in a certain posture. If the specific posture changes, the directional indication changes accordingly.

In addition, the descriptions, such as "first," "second" in the embodiments of the present disclosure, are only for descriptive purposes, and cannot be understood as indicating or suggesting relative importance or impliedly indicating the number of the indicated technical feature. Therefore, the feature associated with the "first," the "second" can expressly or impliedly include at least one such feature. Besides, the technical solutions of the various embodiments can be combined with each other, as long as they do not conflict with each other.

Referring to FIG. 1, the present disclosure provides a window air conditioner 10. The window air conditioner 10 may be mounted at the mounting opening of the wall to cool or heat the indoor environment. The window air conditioner 10 includes a sealing member 400, and the assembly method of the sealing member 400 can be simplified, thereby improving the assembly efficiency of the whole machine.

Figure 2:
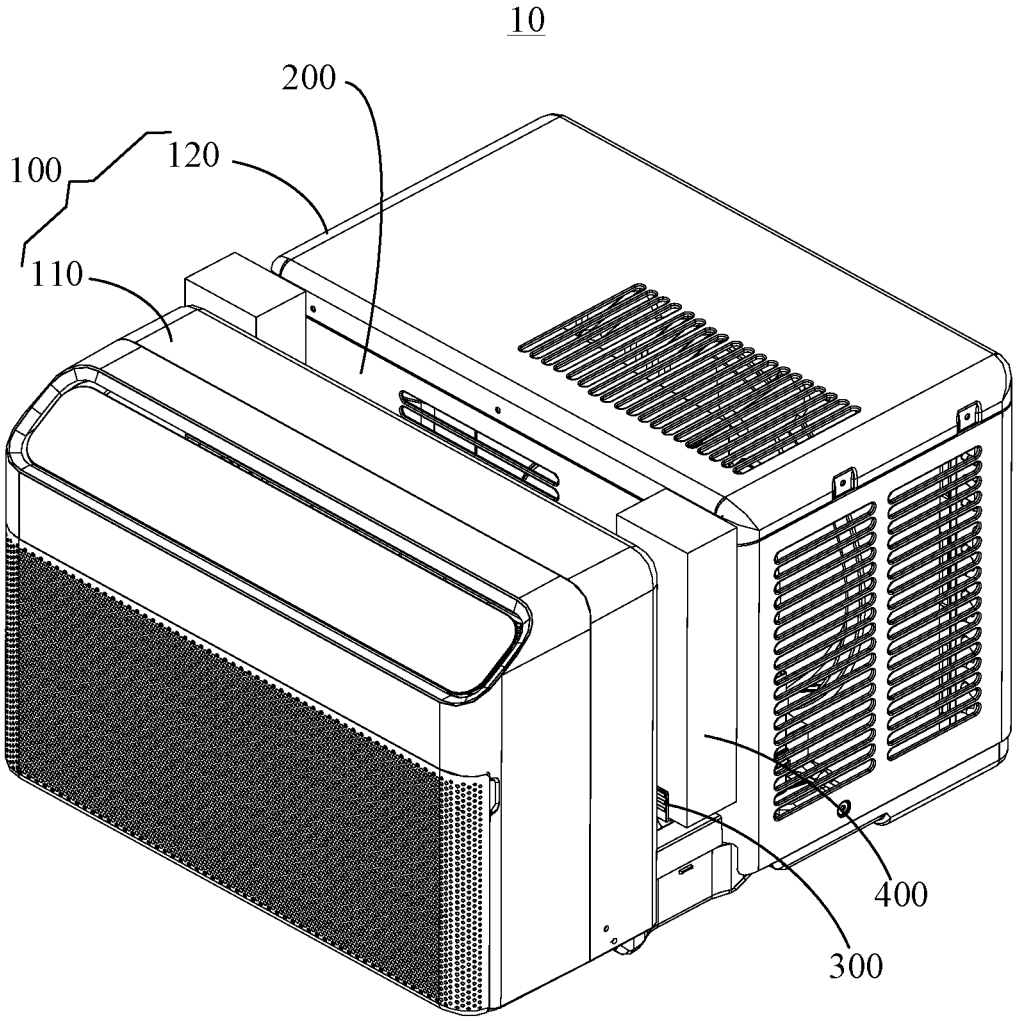
FIG. 2 is a schematic diagram showing a sealing member of the window air conditioner in a storage state according to the present disclosure.
Figure 3:
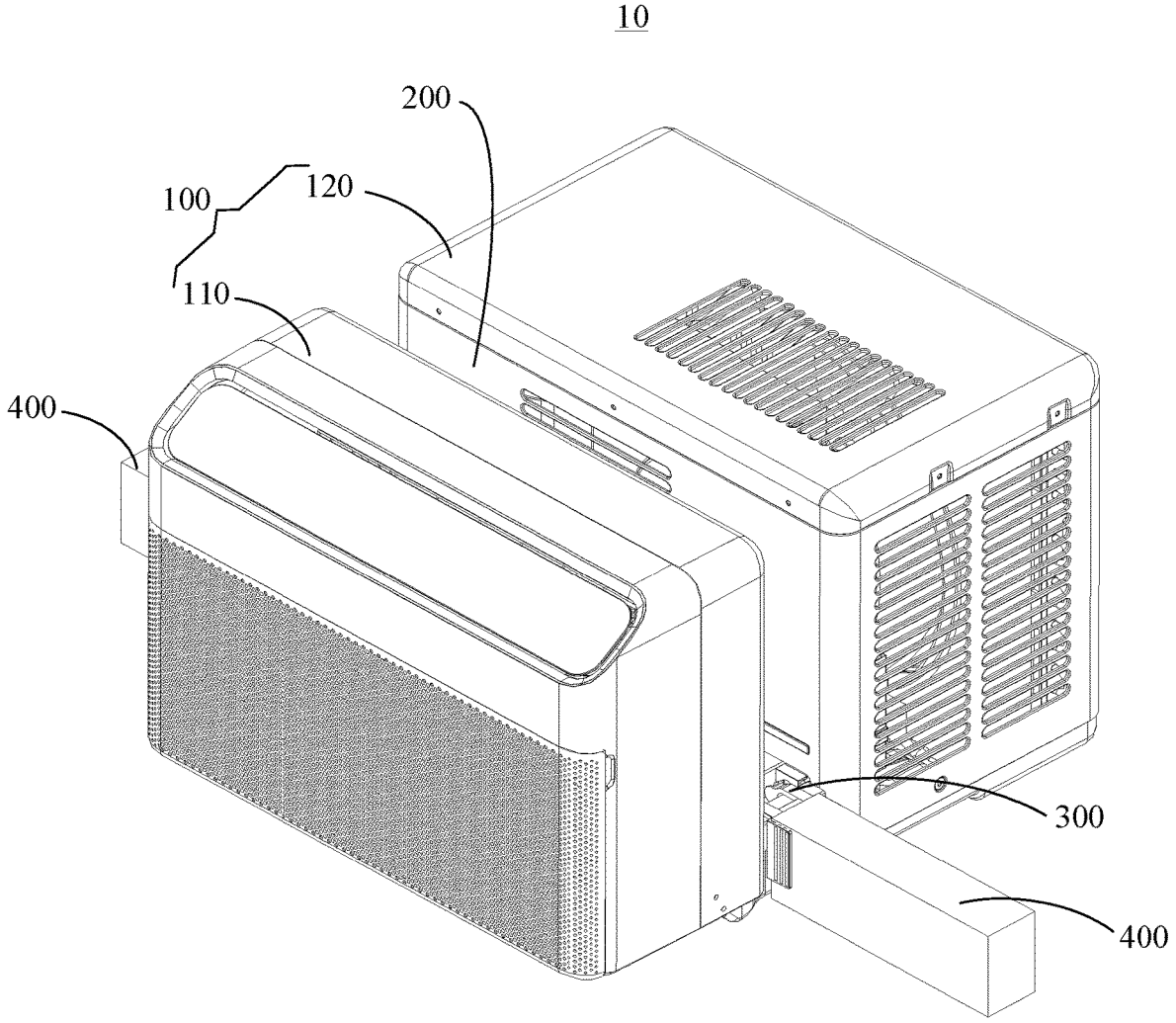
FIG. 3 is a schematic diagram showing switching the sealing member of the window air conditioner in FIG. 2 to the working state.

Referring to FIG. 1 to FIG. 3, in an embodiment of the present disclosure, the window air conditioner 10 includes a housing 100, a mounting base 300, and a sealing member 400. The housing 100 includes a separation groove 200, the separation groove 200 is configured for a shielding member 30 of a window to extend into. The mounting base 300 is movably mounted in the separation groove 200. The sealing member 400 is connected with the mounting base 300 through insertion, the sealing member 400 is in interference fit with the mounting base 300 by deformation, and the sealing member 400 is driven by the mounting base 300 to switch between a storage state and a working state. In the storage state, the sealing member 400 is received in the separation groove 200; in the working state, the sealing member 400 is configured to extend laterally from the separation groove 200, and abut on the shielding member 30 and/or an inner wall of the window. In some embodiments, in the working state, the sealing member 400 is configured to extend laterally from the separation groove 200, and abut on an inner wall of a window frame.

Specifically, top and both sides of the separation groove 200 of the housing 100 are open, and the housing 100 is partitioned by the separation groove 200 into an indoor housing 110 and an outdoor housing 120. The window air conditioner 10 further includes a compressor, an outdoor heat exchanger, an outdoor fan, an indoor heat exchanger, and an indoor fan. The compressor, the outdoor heat exchanger, and the outdoor fan are mounted in the outdoor housing 120. The indoor heat exchanger and the indoor fan are mounted in the indoor housing 110.

After the window air conditioner 10 is mounted at the mounting opening of the wall, the indoor housing 110 is located indoors, and the outdoor housing 120 is located outdoors. This not only can block the noise from the outdoor to the indoor, to achieve the noise reduction effect, but also can allow the shielding member 30 mounted at the mounting opening to extend into the separation groove 200 to reduce the interference of the window air conditioner 10 on the shielding member 30. It should be noted that the shielding member 30 may be a curtain, a window shutter, a sash, etc., that blocks light, or other protective window panels that may block external objects from entering the room.

There are two sealing members 400. The two sealing members 400 are provided at both ends of the separation groove 200. The sealing member 400 is elongated. The sealing member 400 has multiple side surfaces, and the multiple side surfaces have a larger outer surface area, which is beneficial to increase the sealing surface. The sealing member 400 is connected with the mounting base 300 through insertion, which may be specifically but not limited to: one of the sealing member 400 and the mounting base 300 is provided with a slot, and the other is inserted in the slot. Since the sealing member 400 can be elastically or flexibly deformed, during the process of inserting and connecting the sealing member 400 and the mounting base 300, the sealing member 400 may be flexibly or elastically deformed, such that the insertion portion between the sealing member 400 and the mounting base 300 is tightly connected, thereby making it difficult for the sealing member 400 and the mounting base 300 to separate, and achieving interference fit fixing.

To facilitate the illustration of the installation of the window air conditioner 10, a square mounting opening in the wall 20 is used as an example for explanation: the inner wall of the mounting opening includes a bottom wall, a top wall, and two opposite side walls. The shielding member 30 is usually provided at the top wall of the mounting opening, and can move up and down to block or open the mounting opening. After the window air conditioner 10 is mounted in the mounting opening, the sealing member 400 is moved to the working state through the mounting base 300, so that the sealing member 400 protrudes laterally from the separation groove 200 of the window air conditioner 10, and the bottom surface of the sealing member 400 abuts against the bottom wall of the mounting opening. Then, the shielding member 30 is pulled down to extend into the separation groove 200 of the window air conditioner 10 until the lower edge of the shielding member 30 contacts and abuts against the upper surface of the sealing member 400. The sealing member 400 blocks and seals the gap between the shielding member 30 and the bottom wall of the mounting opening, and reduces the cooling or heat leakage in the room from the space to the outside. When the window air conditioner 10 is not needed or is being transported, the sealing member 400 is moved to the storage state to reduce the space occupied by the sealing member 400, which is convenient for the window air conditioner 10 to be received or packaged.

During the process of installing the window air conditioner 10 described above, compared to the related art, which can only be pulled to the top surface of the window air conditioner 10, the shielding member 30 in this embodiment can be inserted into the window air conditioner 10, such that the shielding member 30 can block the space between the two sides of the window air conditioner 10 and the bottom wall of the mounting opening, and increase the blocking area of the shielding member 30.

In the technical solutions of the present disclosure, the sealing member 400 is connected with the mounting base 300 through insertion, the sealing member 400 is in interference fit with the mounting base 300 by deformation, such that the assembly of the sealing member 400 and the mounting base 300 does not require components such as a screw structure or a clamping structure, the assembly process is relatively simple, and the operation difficulty is low, which helps to improve assembly efficiency. The deformation may be flexible deformation or elastic deformation.

Further, the sealing member 400 is driven by the mounting base 300 to switch between a storage state and a working state. In the storage state, the sealing member 400 is received in the separation groove 200 to fully utilize the separation groove 200 to store the sealing member 400, which reduces the volume of the window air conditioner 10 and is convenient for storage or packaging and transportation. In the working state, the sealing member 400 is configured to extend laterally from the separation groove 200, and is configured for abutting on the shielding member 30 and/or an inner wall of the window to seal the gap between the shielding member 30 and the inner wall of the mounting opening, and to reduce the leakage of cold or heat to the outside, and to prevent water in the outdoor environment from falling into the room from the gap, which greatly enhances the sealing effect.

Besides, since the sealing member 400 can be deformed flexibly or elastically, so that when the shielding member 30 abuts downwards on the surface of the sealing member 400, the sealing member 400 also undergoes slight deformation, which can make the seal between the sealing member 400 and the shielding member 30 tighter. It is not easy to form a gap between the sealing member 400 and the shielding member 30, which improves the sealing effect, and effectively enhances the effect of waterproof, leakproof, cold heat.

Figure 4:
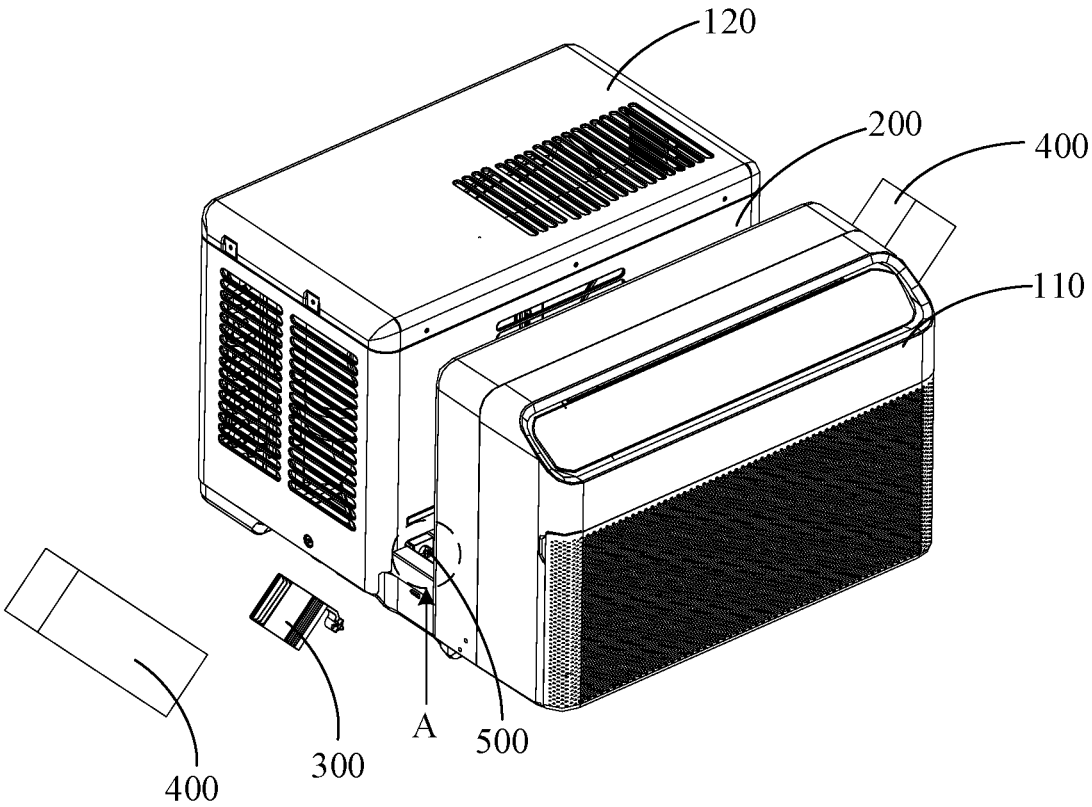
FIG. 4 is an exploded view of the sealing member and a mounting base of the window air conditioner in FIG. 2.
Figure 5:
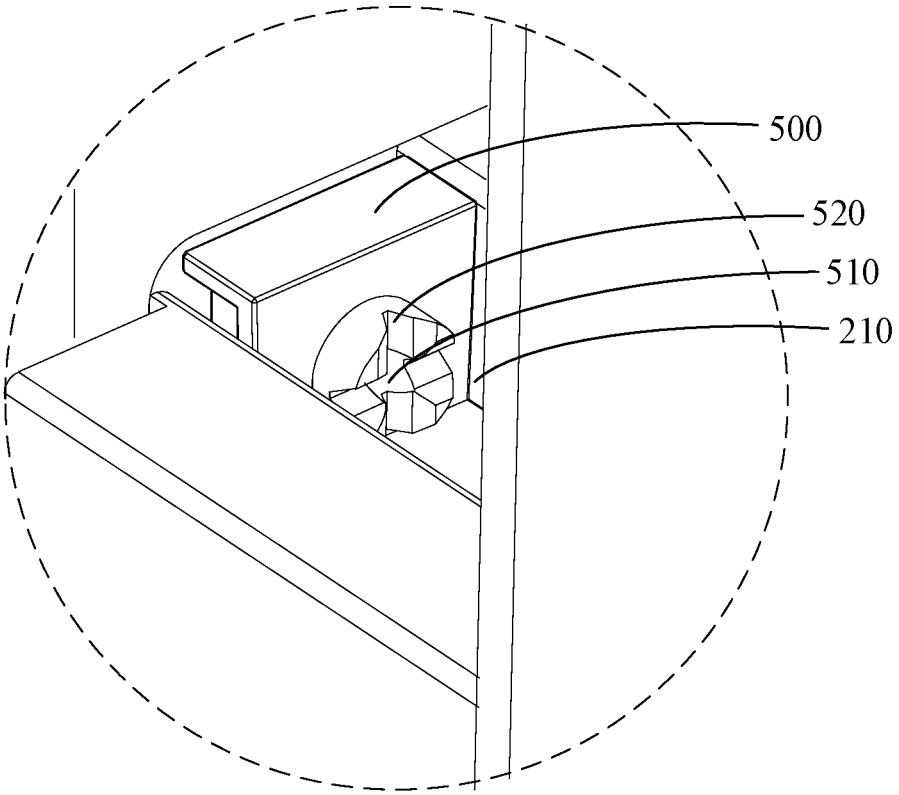
FIG. 5 is an enlarged view of portion A in FIG. 4.
Figure 6:
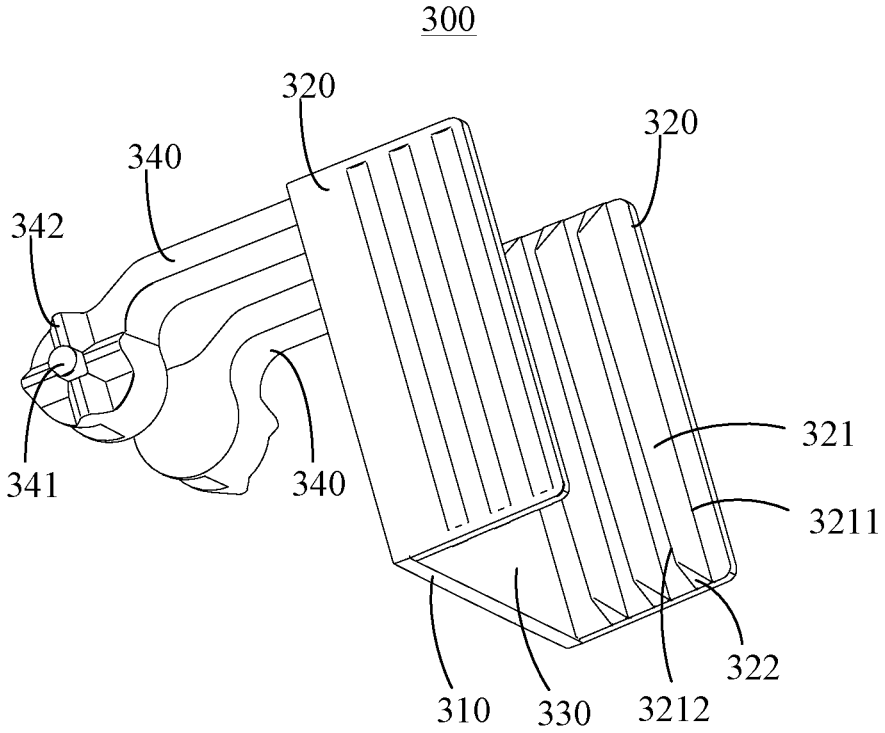
FIG. 6 is a schematic structural diagram showing the mounting base in FIG. 4.

Referring to FIGS. 4-6, in the above embodiments, there are various design methods for the movable installation method of the mounting base 300, which is not specifically limited herein. For example, but not limited to: the mounting base 300 is slidably mounted in the separation groove 200; or, the mounting base 300 is rotatably mounted in the separation groove 200; alternatively, the mounting base 300 may be rollably mounted in the separation groove 200. It can be selected according to the difficulty of assembly. Specifically, the mounting base 300 is rotatably mounted in the separation groove 200 herein.

The specific structure of the mounting base 300 is also not limited here. The corresponding design can be made with reference to the size of the separation groove 200 and the size of the required sealing member 400. In this embodiment, in order to facilitate the installation of the mounting base 300, optionally, the mounting base 300 includes a bottom mounting plate 310 and side mounting plates 320 on opposite sides of the bottom mounting plate 310. The bottom mounting plate 310 is rotatably mounted in the separation groove 200, and a mounting slot 330 for inserting the sealing member 400 is formed between the bottom mounting plate 310 and the two side mounting plates 320.

Specifically, the bottom mounting plate 310 of the mounting base 300 and the two side mounting plates 320 surround to form a mounting slot 330. The mounting slot 330 is generally U-shaped, and one end of the mounting slot 330 forms an insertion opening. The end of the mounting base 310 away from the insertion opening is rotatably mounted in the separation groove 200. When the sealing member 400 is mounted at the mounting base 300, first, align one end of the sealing member 400 with the insertion opening of the mounting slot 330 on the mounting base 300, and then apply an external force to the sealing member 400 to press the sealing member 400 into the mounting slot 330. During the process, the sealing member 400 is deformed by the pressing force of the inner wall of the mounting slot 330, thus the sealing member 400 is tightly squeezed in the mounting slot 330, and the sealing member 400 and the mounting base 300 are tightly fitted, not easy to separate, and the installation stability is better.

Referring to FIG. 6 to FIG. 9, in an embodiment, in order to facilitate the insertion of the sealing member 400 into the mounting slot 330, a guiding protrusion bar 321 may protrude on the inner wall surface of the side mounting plate 320, and the guiding protrusion bar 321 may be elongated and extended in the insertion direction of the mounting slot 330. The guiding protrusion bar 321 is integrally formed with the side mounting plate 320. The number of the guiding protrusion bars 321 is plural, and a plurality of guiding protrusion bars 321 are spaced apart from each other along the height direction of the side mounting plate 320.

Therefore, during the process of inserting the sealing member 400 into the mounting slot 330, the guiding protrusion bars 321 on the two side mounting plates 320 cooperate to limit the insertion direction of the sealing member 400, such that the sealing member 400 is less likely to be misaligned and deviate from the mounting slot 330, ensuring that the sealing member 400 is accurately inserted in the mounting slot 330. Besides, since the guiding protrusion bar 321 protrudes from the inner wall surface of the side mounting plate 320, the guiding protrusion bars 321 on the two side mounting plates 320 can cooperate to squeeze the sealing member 400, such that the sealing member 400 is easily deformed by squeezing and tightly cooperates with the mounting base 300, and is not easy to fall out of the mounting slot 330.

Figure 7:
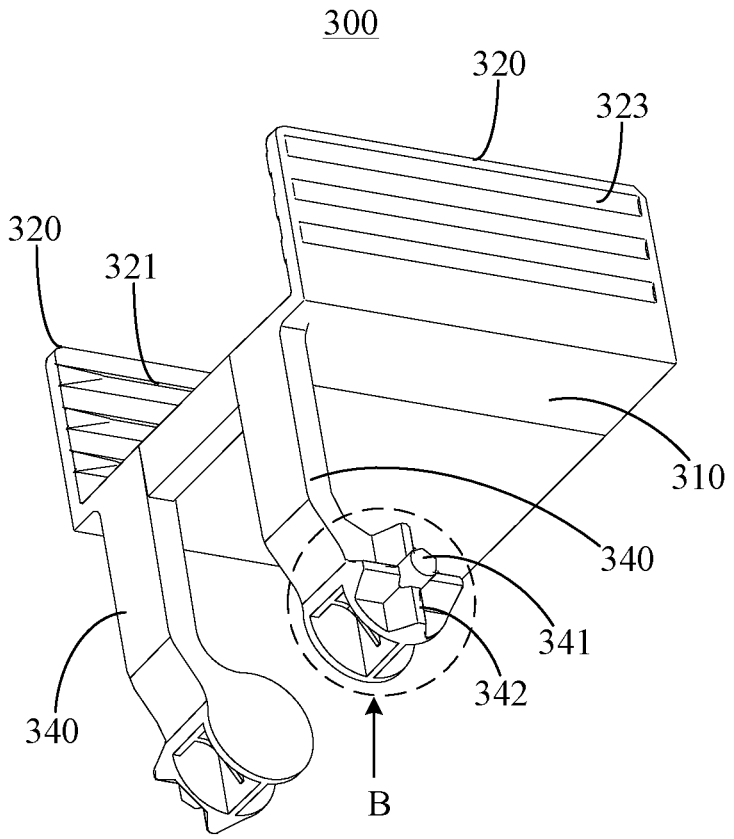
FIG. 7 is a schematic structural diagram showing the mounting base of FIG. 6 from another perspective.
Figure 8:
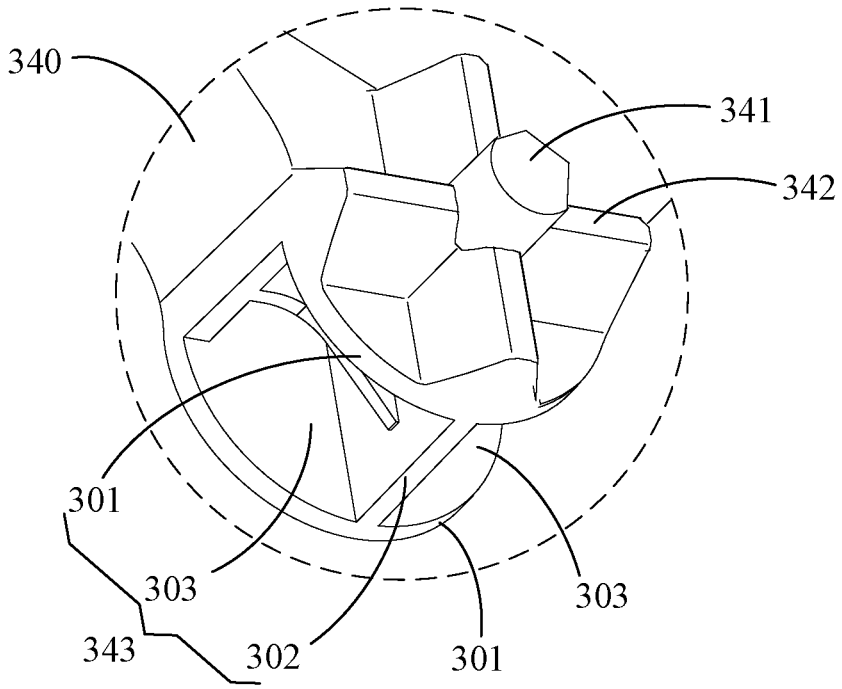
FIG. 8 is an enlarged view of portion B in FIG. 7.
Figure 9:
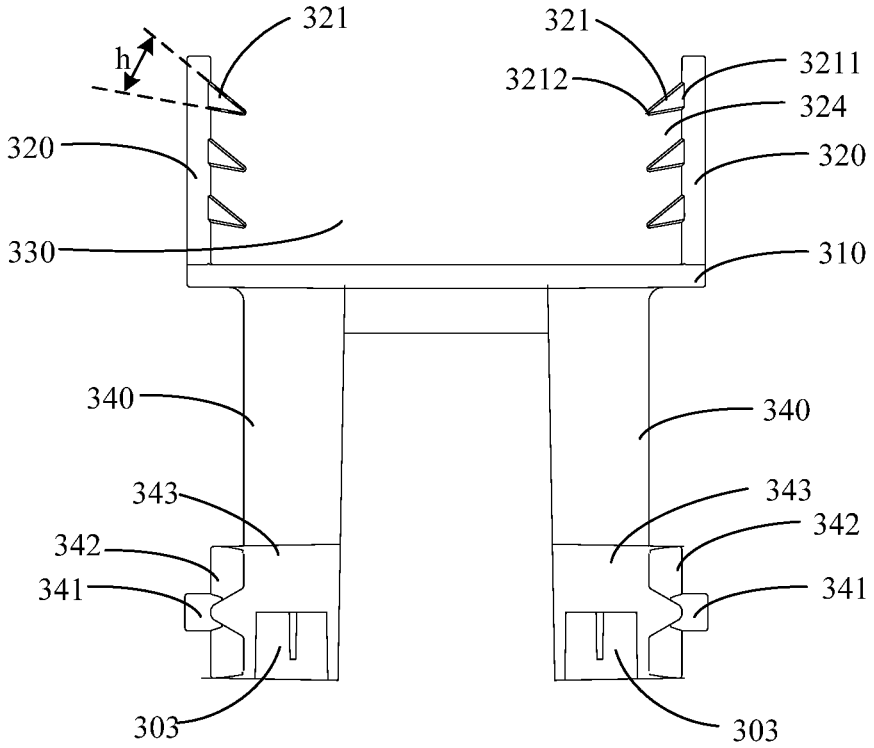
FIG. 9 is a front view of the mounting base in FIG. 6 along its insertion direction.

Referring to FIG. 6 to FIG. 9, in an embodiment, the guiding protrusion bar 321 has a root 3211 connected to the side mounting plate 320 and a top 3212 away from the side mounting plate 320. The thickness of the guiding protrusion bar 321 gradually decreases from the root 3211 to the top 3212. As shown in FIG. 9, h represents the thickness of the guiding protrusion bar 321. It should be understood that the cross section of the guiding protrusion bar 321 is perpendicular to its length direction, and the thickness of the cross section gradually decreases from the bottom to the top 3212, thus the top 3212 of the guiding protrusion bar 321 is narrower. As a result, the contact area between the guiding protrusion bar 321 and the sealing member 400 may be reduced. Under the same squeezing force, the pressure exerted by the guiding protrusion bar 321 on the sealing member 400 is greater. Furthermore, in the process of clamping the sealing member 400, the guiding protrusion bar 321 may squeeze the sealing member 400 to cause a large deformation, thereby further increasing the tightness of the connection between the sealing member 400 and the mounting seat 300.

It is considered here that since the top 3212 of the mounting slot 330 is open, the sealing member 400 may be detached from the top 3212 of the mounting slot 330. To avoid this, optionally, the guiding protrusion bar 321 is inclined towards the bottom wall of the mounting slot 330 from the root 3211 to the top 3212. When the sealing member 400 is inserted in the mounting slot 330, the force of the guiding protrusion bar 321 on the sealing member 400 is directed to the bottom wall of the mounting slot 330, thereby, the sealing member 400 is tightly limited in the mounting slot 330, and the sealing member 400 is prevented from coming off from the top 3212 of the mounting slot 330.

Referring to FIG. 6, besides, in order to facilitate the insertion of the sealing member 400 into the mounting slot 330, a guiding slope 322 may be formed at the end of the guiding protrusion bar 321, and the guiding slope 322 is inclined along the insertion direction of the mounting slot 330. When the sealing member 400 is mounted at the mounting base 300, after one end of the sealing member 400 is aligned with the insertion opening of the mounting slot 330 on the mounting base 300, an external force is applied to push the sealing member 400 into the mounting slot 330, the outer surface of the sealing member 400 first contacts the guiding slope 322 of the guiding protrusion bar 321, and then is guided through the guiding slope 322 to enter the mounting slot 330. The design of the guiding slope 322 can greatly reduce the resistance of the front end of the guiding protrusion bar 321 to the sealing member 400, and help guide the sealing member 400 into the mounting slot 330.

Referring to FIG. 7 and FIG. 9, in an embodiment, the outer wall surface of the side mounting plate 320 is further provided with a groove 323, and the groove 323 is elongated and extends along the insertion direction of the mounting slot 330. The groove 323 can increase the friction coefficient of the outer surface of the side mounting plate 320 to facilitate the user to align and insert the mounting slot 330 and the sealing member 400 with the side mounting plate 320 in hand. Besides, a recess 324 is formed between two adjacent guiding protrusion bars 321, and the groove 323 corresponds to the position of the recess 324 of the side mounting plate 320, so that the position of the thickness variation of the side mounting plate 320 is substantially the same, which is advantageous for the molten colloid to flow in the cavity corresponding to the inner and outer surface positions of the side mounting plate 320 during injection, so as to form the mounting seat 300 with a relatively stable shape and structure by injection.

Referring to FIG. 4, FIG. 5 and FIG. 7, based on any one of the above embodiments, for a specific embodiment in which the mounting base 300 is rotatably mounted in the separation groove 200, optionally, a pair of rotation arms 340 protrude downwards from the bottom mounting plate 310 of the mounting base 300; a fixation base 500 is mounted in the separation groove 200, and the fixation base 500 is rotatably connected to the rotation arm 340. The specific structure of the fixation base 500 is not specifically limited, and can be designed accordingly according to actual needs.

In an embodiment, the fixation base 500 includes a bottom fixation plate 510 and two side fixation plates 520, a first side fixation plate and a second side fixation plate, on two sides of the bottom fixation plate 510, respectively, and a receiving groove 501 into which the rotation arm 340 extends is formed between the two side fixation plates 520. One of the side fixation plate 520, e.g., the first side fixation plate, and the rotation arm 340 is configured to form a rotation shaft 341, and the other of the side fixation plate 520, e.g., the first side fixation plate, and the rotation arm 340 is configured to form a shaft hole 521 corresponding to the rotation shaft 341.

Specifically, the rotation shaft 341 may be provided at the rotation arm 340, and a shaft hole 521 corresponding to the rotation shaft 341 may be provided at the side fixation plate. The shaft hole 521 is correspondingly inserted by the rotation shaft 341 of the rotation arm 340, so that the mounting base 300 is rotatably connected to the fixation base 500. Alternatively, the rotation shaft 341 may be provided at the side fixation plate 520, and a shaft hole 521 corresponding to the rotation shaft 341 may be provided at the rotation arm. The shaft hole 521 is correspondingly inserted by the rotation shaft 341 of the rotation arm 340, and the mounting base 300 is rotatably connected to the fixation base 500. In the following, the rotation arm 340 is provided with the rotation shaft 341 and the side fixation plate 520 is provided with a shaft hole 521 as an example for description.

Figure 11:
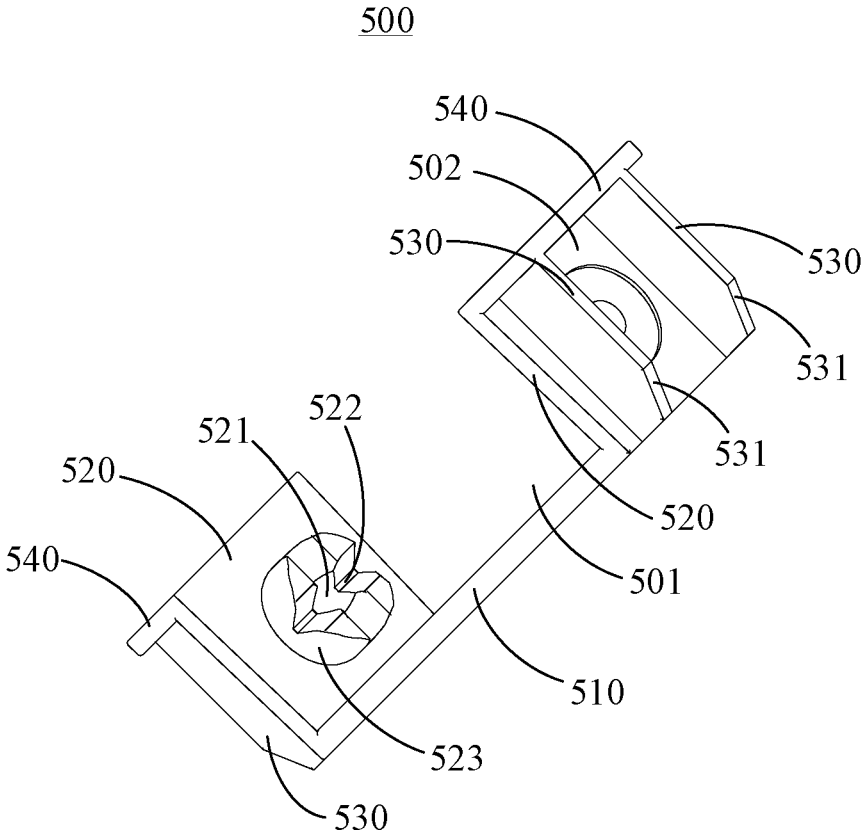
FIG. 11 is a schematic structural diagram showing the fixation base in FIGS. 4.

Referring to FIG. 7 to FIG. 9, further, a rotation portion 343 is formed at an end of the rotation arm 340 of the mounting base 300, and the rotation portion 343 has two opposite side walls 301, and one of the side walls 301 is convexly formed with a rotation shaft 341. The side fixation plate 520 of the fixation base 500 protrudes towards the receiving groove 501 with a boss 523 (as shown in FIG. 11). The boss 523 is formed with a shaft hole 521, and the shaft hole 521 is correspondingly inserted by the rotation shaft 341.

Specifically, the shaft hole 521 is formed at the boss 523, and the shaft hole 521 penetrates the boss 523; the rotation shaft 341 of the rotation arm 340 passes through the shaft hole 521, so that the rotation shaft 341 can be inserted and stabilized in the shaft hole 521. The boss 523 can enhance the strength of the position near the shaft hole 521, so that the shaft hole 521 is correspondingly inserted by the rotation shaft 341 to stably support the rotation shaft 341 of the mounting base 300, thereby enhancing the stability of the insertion with the rotation shaft 341. The rotation shaft 341 of the rotation arm 340 passes through the shaft hole 521. The outer end of the rotation shaft 341 may interfere with the back plate of the indoor housing 110 or the back plate of the outdoor housing 120, and the rotation shaft 341 continuously generates friction when rotating.

Referring to FIG. 7 to FIG. 11, to ensure that the fixation base 500 can provide enough space for the rotation of the rotation shaft 341, optionally, the fixation base 500 further includes two rib plates 530 on the surface of the side fixation plate 520 away from the boss 523, and a cover plate 540 connected to a side edge of the side fixation plate 520 away from the bottom fixation plate. The cover plate 540 is connected to the two rib plates 530 and enclosed with the two rib plates 530 to form an avoiding groove 502 corresponding to the shaft hole 521. Therefore, the rotation shaft 341 of the rotation arm 340 is inserted in the avoiding groove 502 from the shaft hole 521 to be received in the avoiding groove 502. When rotating, the rotation shaft 341 is less likely to interfere with the back plate of the indoor housing 110 or the back plate of the outdoor housing 120.

Specifically, the side fixation plate 520 is connected to the two rib plates 530 and the cover plate 540 to form a stable structure, which can enhance the strength of the side fixation plate 520 and make it difficult for both ends of the side fixation plate 520 to bend. When mounting the fixation base 500, the rib plate 530 and the cover plate 540 at the end of the fixation base 500 are inserted corresponding to the side walls of the separation groove 200. The contact surface with the separation groove 200 is small, which can reduce the interference of the side wall of the separation groove 200 and facilitate the installation of the fixation base 500 in the separation groove 200.

The side fixation plate 520, the two rib plates 530 and the cover plate 540 of the fixation base 500 cooperate to form the side of the fixation base 500. Theoretically, the side of the fixation base 500 is designed as a solid block structure (that is, no avoiding groove 502 is formed between the two rib plates 530 and the cover plate 540), and the side of the fixation base 500 will have better strength. However, the fixation base 500 is usually injection molded using an injection process. Due to the large thickness of the side of the fixation base 500, it is not easy to completely fill the corresponding mold cavity with a molten material in the production process of injection. Therefore, it is possible that the surface of the side portion of the fixation base 500 is easily recessed into the inside thereof, and a recess is formed, which destroys the structural stability of the fixation base 500. Therefore, in this embodiment, due to the existence of the avoiding groove 502, the side of the fixation base 500 can be equivalent to forming a hollow structure, which is beneficial to the injection production of the fixation base 500.

Further, the lower end of the rib plate 530 is chamfered to form a guiding portion 531 at the chamfered position of the rib plate 530. When mounting the fixation base 500, the side wall of the guiding portion 531 corresponding to the sink groove 210 can be inserted downwards into the sink groove 210, reducing the resisting force between the rib plate 530 and the side wall of the sink groove 210, thereby reducing the difficulty of mounting the fixation base 500 and improving the assembly efficiency.

In an embodiment, the rotation portion 343 may also be a solid block structure, so that it has better strength. However, the mounting base 300 is usually injection molded using an injection process. Since the thickness of the rotation portion 343 is large, during the production process of injection, it is not easy to completely fill the mold cavity of the corresponding rotating part 343 with a molten material, therefore, it is possible that the side wall 301 of the rotation portion 343 is easily recessed into the inside, and a recess is formed in the side wall 301 of the rotation portion 343. To solve this problem, a connection plate 302 is connected between the two side walls 301 of the rotation portion 343, and a hollow groove 303 is formed between two adjacent connection plates 302, which makes the rotation portion 343 being a non-solid structure, and is beneficial to the injection production of the mounting base 300, thereby avoiding forming the recess on the side wall 301 of the rotation portion 343, and ensuring the structural integrity of the rotation portion 343 and ensuring that the rotation portion 343 has better strength.

Figure 10:
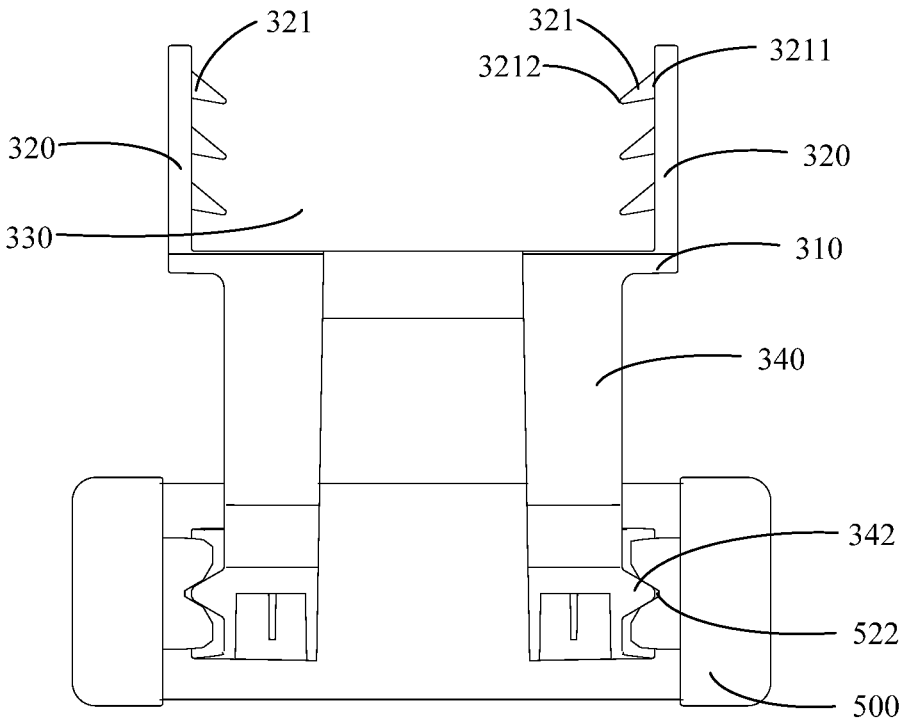
FIG. 10 is a schematic diagram showing the rotation connection of the mounting base and the fixation base in FIG. 9.

Referring to FIG. 5, FIG. 9 and FIG. 10, in an embodiment, the rotation angle of the rotation arm 340 of the mounting base 300 can be adjusted, so that the angle between the sealing member 400 and the horizontal direction can be adjusted by adjusting the rotation angle of the mounting base 330, for example, 90°, 45°, or 30°. As for the manner in which the rotation angle of the sealing member 400 can be adjusted, there are various ways. Again, there is no specific limit.

In some embodiments, one of the fixation base 500 and the rotation arm 340 is formed with a positioning protrusion 342 on a periphery of the rotation shaft 341, and the other is formed with a plurality of positioning grooves 522 on a periphery of the shaft hole 521. When the mounting base 300 rotates to a preset angle, the positioning protrusion 342 cooperates with one of the positioning grooves 522 to position the mounting base 30.

Specifically, the plurality of positioning grooves 522 are arranged in a circular ring shape along the periphery of the shaft hole 521.

Figure 12:
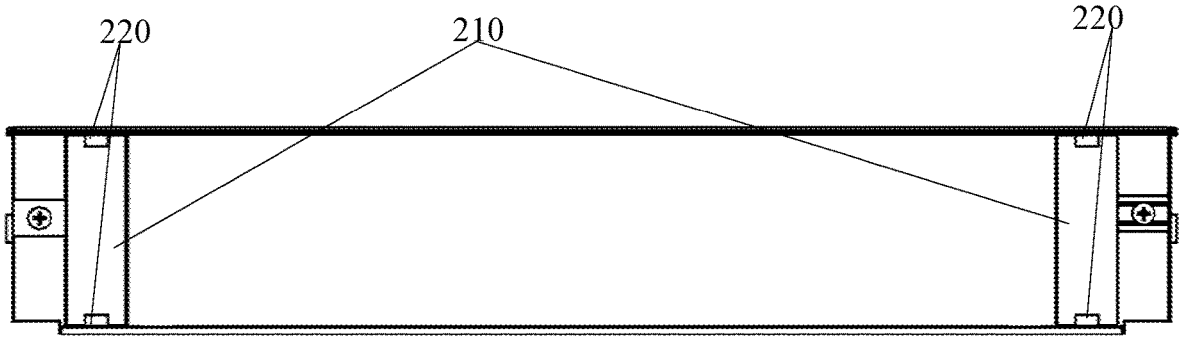
FIG. 12 is a schematic diagram showing a sink groove according to the present disclosure.

Here, it is considered that since the part close to the separation groove 200 is exposed to the outside, water dripping onto the mounting base 300 in the outdoor environment can easily enter the fixation base 500 and fall into the indoor housing 110. Therefore, in order to avoid this, a sink groove 210 for mounting the fixation base 500 is provided at the bottom of the separation groove 200, and as shown in FIG. 12, the sink groove 210 is provided with a drain hole 220, which is configured to drain water outdoors or in a water receiving tray. The water dripping onto the mounting base 300 in the outdoor environment will drop into the sink groove 210 first, and then be discharged from the drain hole 220 of the sink groove 210 to the outdoor or the water receiving tray to avoid wetting the internal components of the indoor housing 110.

Besides, the fixation base 500 can be directly limited and fixed in the sink groove 210 to limit the fixation base 500 by the side wall of the circumference of the sink groove 210, which can reduce the use of components such as the screw structure or the clamping structure.

Based on any one of the above embodiments, in order to ensure that the sealing member 400 can be deformed and inserted tightly with the mounting base 300. Optionally, the sealing member 400 is made of a flexible material, to flexibly deform the sealing member 400. Alternatively, the sealing member 400 is made of an elastic material to elastically deform the sealing member 400. The specific material of the sealing member 400 may be, but not limited to, hard sponge, deformable plastic, rubber or silicone.

In an embodiment, the mounting openings of the wall usually have different sizes, thus requiring sealing members 400 with different lengths. Here, in order to adapt the sealing member 400 to the mounting openings of different sizes, the sealing member 400 may also be cut to change the length of the sealing member 400. As mentioned above, the sealing member 400 is made of a flexible material or an elastic material, such that the sealing member has better flexibility. Therefore, the sealing member 400 can be cut and its length can be changed to adapt to the mounting openings of different sizes.

The above are only some embodiments of the present disclosure, and thus do not limit the scope of the present disclosure. Based on the present disclosure, equivalent structural transformations made by the description and drawings of the present disclosure, or direct/indirect application in other related technical fields are included in the scope of the present disclosure.

What is claimed is:

1. A window air conditioner comprising:

a housing including a separation groove dividing the housing into two parts;

a mounting base movably mounted in the separation groove, the mounting base including:

a bottom mounting plate rotatably mounted in the separation groove;

two side mounting plates formed at opposite sides of the bottom mounting plate, respectively, wherein the two side mounting plates together with the bottom mounting plate form a mounting slot, each of the two side mounting plates includes a guiding protrusion bar that protrudes toward the opposite side of the bottom mounting plate; and a rotation arm protruding from a bottom of the mounting base;

a sealing member connected with the mounting base and received in the mounting slot, the sealing member being fitted with the mounting base by deformation; and a fixation base mounted in the separation groove, the fixation base including:

a bottom fixation plate; and a first side fixation plate and a second side fixation plate on opposite sides of the bottom fixation plate, respectively, a receiving groove being formed between the first side fixation plate and the second side fixation plate;

wherein:

the mounting base is configured to rotate the sealing member to switch between:

a storage state, in which the sealing member is received in the separation groove; and a working state, in which the sealing member is at least partially outside the separation groove;

the rotation arm is rotatably connected to the fixation base through a shaft hole and a rotation shaft fitted in the shaft hole; and a boss extending towards the receiving groove protrudes on the first side fixation plate, the shaft hole being formed in the boss.

2. The window air conditioner of claim 1, wherein:

the guiding protrusion bar has an elongated shape and extends along an insertion direction of the mounting slot.

3. The window air conditioner of claim 2, wherein for each side mounting plate:

the guiding protrusion bar includes a root connected to an inner wall surface of the side mounting plate and a top away from the inner wall surface of the side mounting plate; and a thickness of the guiding protrusion bar gradually decreases from the root to the top.

4. The window air conditioner of claim 2, wherein for each side mounting plate:

the guiding protrusion bar includes a root connected to an inner wall surface of the side mounting plate and a top away from the inner wall surface of the side mounting plate; and the guiding protrusion bar is inclined towards a bottom wall of the mounting slot from the root to the top.

5. The window air conditioner of claim 2, wherein a guiding slope is formed at an end of the guiding protrusion bar, the guide slope being inclined along the insertion direction of the mounting slot.

6. The window air conditioner of claim 1, wherein:

each of the two side mounting plates includes a groove formed at an outer wall surface of the side mounting plate; and the groove has an elongated shape and extends along an insertion direction of the mounting slot.

7. The window air conditioner of claim 1, wherein a sink groove for mounting the fixation base is provided at a bottom of the separation groove, the sink groove including a drain hole configured to drain water.

8. The window air conditioner of claim 1, wherein:

the rotation arm extends into the receiving groove; and the shaft hole is formed at one of the first side fixation plate and the rotation arm, and the rotation shaft is formed at another one of the first side fixation plate and the rotation arm.

9. The window air conditioner of claim 8, wherein a rotation angle of the rotation arm of the mounting base is adjustable.

10. The window air conditioner of claim 9, wherein:

a plurality of positioning grooves are formed at the one of the first side fixation plate and the rotation arm on a periphery of the shaft hole;

a positioning protrusion is formed at the other one of the first side fixation plate and the rotation arm on a periphery of the rotation shaft; and the positioning protrusion is configured to cooperate with one of the positioning grooves to position the mounting base when the mounting base rotates to a preset angle.

11. The window air conditioner of claim 8, wherein:

a rotation portion is formed at a tail end of the rotation arm, the rotation portion including two opposite side walls, and the rotation shaft protruding on one of the side walls.

12. The window air conditioner of claim 11, wherein a plurality of connection plates are formed between the two side walls of the rotation portion, and a hollow groove is formed between two adjacent ones of the connection plates.

13. The window air conditioner of claim 11, wherein the fixation base further includes:

two rib plates on a surface of the first side fixation plate that faces away from the boss; and a cover plate on a side edge of the first side fixation plate that faces away from the bottom fixation plate, the cover plate being connected to the two rib plates and, together with the two rib plates, forming an avoiding groove corresponding to the shaft hole.

14. The window air conditioner of claim 13, wherein a lower end of one of the rib plates is chamfered to form a guiding portion at a chamfered position of the one of the rib plates.

15. A window air conditioner comprising:

a housing including a separation groove dividing the housing into two parts;

a mounting base movably mounted in the separation groove, the mounting base including:

a bottom mounting plate rotatably mounted in the separation groove;

two side mounting plates formed at opposite sides of the bottom mounting plate, respectively, wherein the two side mounting plates together with the bottom mounting plate form a mounting slot, each of the two side mounting plates includes a guiding protrusion bar that protrudes toward the opposite side of the bottom mounting plate; and a rotation arm protruding from a bottom of the mounting base;

an elastic sealing member configured to be coupled to the housing and received in the mounting slot, the sealing member being fitted with the mounting base by deformation, and the sealing member being configured to rotate with the mounting base; and a fixation base mounted in the separation groove, the fixation base including:

a bottom fixation plate; and a first side fixation plate and a second side fixation plate on opposite sides of the bottom fixation plate, respectively, a receiving groove being formed between the first side fixation plate and the second side fixation plate;

wherein:

the rotation arm is rotatably connected to the fixation base through a shaft hole and a rotation shaft fitted in the shaft hole; and a boss extending towards the receiving groove protrudes on the first side fixation plate, the shaft hole being formed in the boss.

16. The window air conditioner of claim 15, wherein the elastic sealing member is configured to switch between:

a storage state, in which the sealing member is received in the separation groove; and a working state, in which the sealing member is at least partially outside the separation groove.

17. A window air conditioner comprising:

a housing including a separation groove dividing the housing into two parts, a sink groove being provided at a bottom of the separation groove and including a drain hole configured to drain water;

a mounting base movably mounted in the separation groove and including a rotation arm protruding from a bottom of the mounting base;

a sealing member connected with the mounting base, the sealing member being fitted with the mounting base by deformation; and a fixation base mounted at the sink groove of the separation groove, the fixation base including:

a bottom fixation plate; and a first side fixation plate and a second side fixation plate on opposite sides of the bottom fixation plate, respectively, a receiving groove being formed between the first side fixation plate and the second side fixation plate;

wherein:

the mounting base is configured to rotate the sealing member to switch between:

a storage state, in which the sealing member is received in the separation groove; and a working state, in which the sealing member is at least partially outside the separation groove;

the rotation arm is rotatably connected to the fixation base through a shaft hole and a rotation shaft fitted in the shaft hole; and a boss extending towards the receiving groove protrudes on the first side fixation plate, the shaft hole being formed in the boss.

* * * * *